US010082149B2

(12) United States Patent
Meuter et al.

(10) Patent No.: US 10,082,149 B2
(45) Date of Patent: Sep. 25, 2018

(54) PUMP, SEPARATION DEVICE FOR A PUMP, AND ROTOR SHAFT FOR A PUMP

(71) Applicant: Sulzer Pumpen AG, Wintherthur (CH)

(72) Inventors: Paul Meuter, Seuzach (CH); Thomas Welschinger, Radolfzell (DE)

(73) Assignee: Sulzer Pumpen AG, Winterthur (CH)

( * ) Notice: Subject to any disclaimer, the term of this patent is extended or adjusted under 35 U.S.C. 154(b) by 1211 days.

(21) Appl. No.: 13/763,577

(22) Filed: Feb. 8, 2013

(65) Prior Publication Data

US 2013/0315709 A1 Nov. 28, 2013

(30) Foreign Application Priority Data

Feb. 10, 2012 (EP) ..... 12154903

(51) Int. Cl.
*F04D 13/06* (2006.01)
*F04D 29/06* (2006.01)
*F04D 7/04* (2006.01)

(52) U.S. Cl.
CPC ..... *F04D 29/06* (2013.01); *F04D 7/04* (2013.01); *F04D 29/061* (2013.01); *F04D 13/062* (2013.01); *F04D 13/0606* (2013.01)

(58) Field of Classification Search
CPC .... F04D 13/0606; F04D 13/062; F04D 29/06; F04D 29/061; F04D 29/063
USPC ..... 415/111, 121.2
See application file for complete search history.

(56) References Cited

U.S. PATENT DOCUMENTS 2,830,755 A * 4/1958 Anderson ..... F04D 29/063 415/175
2,844,418 A 7/1958 Audemar
3,230,890 A * 1/1966 Hidekuni ..... F04D 9/003 415/109
RE26,570 E 4/1969 Dunn et al.
4,410,337 A * 10/1983 Gullichsen ..... B01D 19/0057 162/55
4,675,033 A * 6/1987 Fellman ..... B01D 19/0052 55/406

(Continued)

FOREIGN PATENT DOCUMENTS

CH 557 472 12/1974
CH 672 007 A5 10/1989

(Continued)

OTHER PUBLICATIONS

European Search Report dated Jul. 23, 2012, for EP Patent Application No. 12154903.4, 7 pages.

*Primary Examiner* — Justin Seabe
*Assistant Examiner* — Behnoush Haghighian
(74) *Attorney, Agent, or Firm* — Kilpatrick Townsend & Stockton LLP

(57) ABSTRACT

Disclosed is a pump having a pump rotor rotatably supported about an axis of rotation in a pump stator. In this respect, the pump rotor is designed and is arranged above a rotor shaft in a shaft bearing such that a lubricating film of a lubricating fluid formed from the pump fluid can be formed in a lubricating ring gap between the rotor shaft and the shaft bearing. In accordance with the invention, a separation device is provided at the rotor shaft by which a predefinable quantity of the ingredient can be separated from the pump fluid by means of a centrifugal force in the operating state for providing the lubricating fluid.

15 Claims, 4 Drawing Sheets

(56) References Cited

U.S. PATENT DOCUMENTS

Figure 1A:
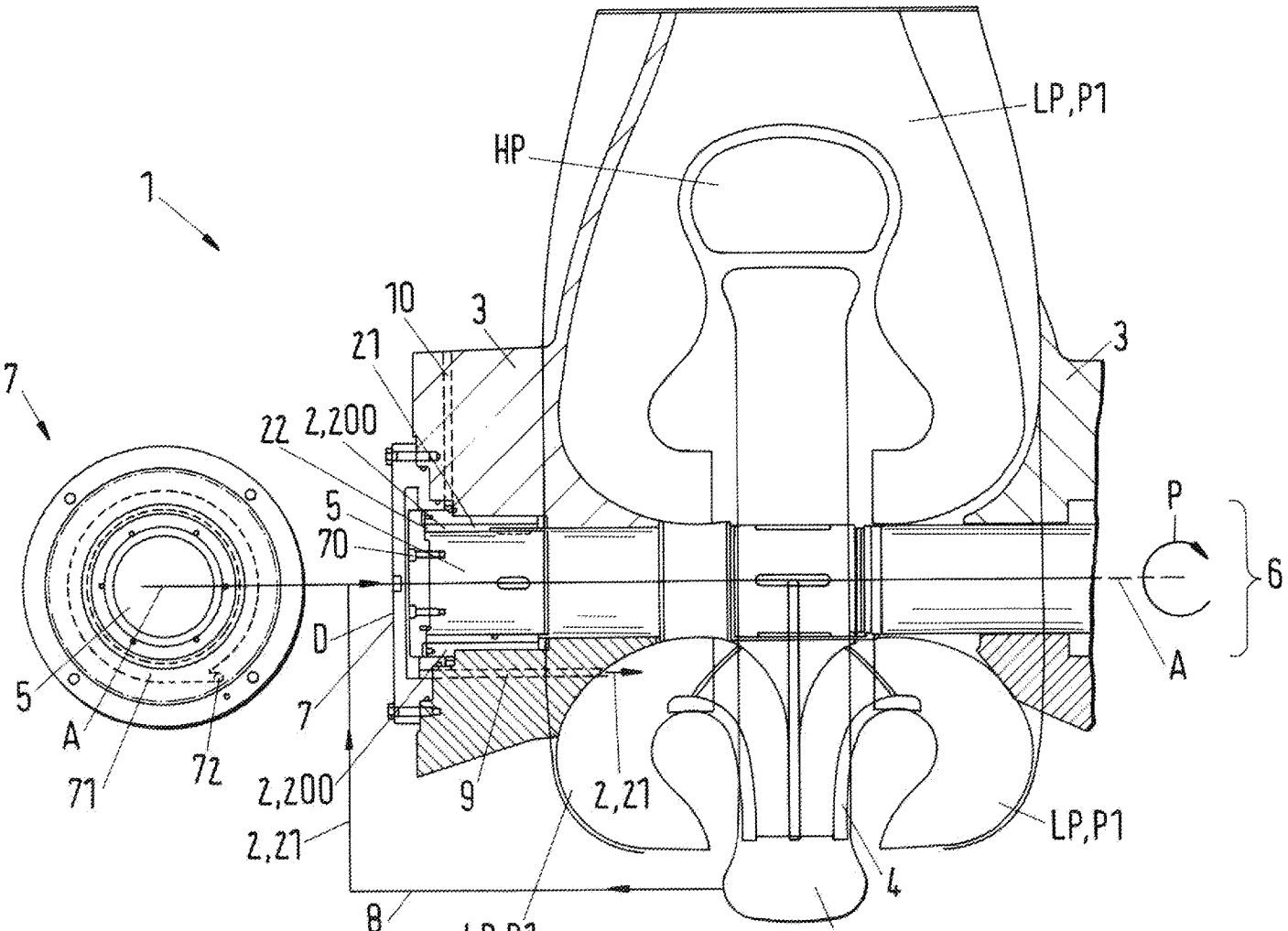

| | | | | |
|---|---|---|---|---|
| 5,118,466 | A * | 6/1992 | Raymond | F04D 29/0413 376/361 |
| 5,248,245 | A | 9/1993 | Behnke et al. | |
| 5,711,789 | A * | 1/1998 | Elonen | B01D 19/0052 95/261 |
| 7,338,252 | B2 * | 3/2008 | Meuter | F04D 7/06 415/107 |
| 7,435,277 | B2 * | 10/2008 | Raussi | B01D 19/0052 55/406 |

FOREIGN PATENT DOCUMENTS

| | | | | |
|---|---|---|---|---|
| DE | 1 653 738 | | 4/1972 | |
| EP | 0 447 106 | A2 | 9/1991 | |
| EP | 0 447 106 | A3 | 9/1991 | |
| GB | 1071266 | A * | 6/1967 | F04D 13/0613 |
| WO | 91/12412 | A1 | 8/1991 | |

* cited by examiner

PUMP, SEPARATION DEVICE FOR A PUMP, AND ROTOR SHAFT FOR A PUMP

This application claims priority to the European Patent Application No. 12154903.4, filed Feb. 10, 2012, the disclosure of which is incorporated by reference herein.

The invention relates to a pump for conveying a pump fluid including an ingredient, to a separation device, and to a rotor shaft for a pump in accordance with the preamble of the independent claims 1, 11 and 14.

It is a well-known measure in the prior art to lubricate rotating parts of pumps by the actual medium to be pumped, which has the obvious advantage that then no special lubricant has to be provided for these lubrication applications. This can above all be of particular advantage when the provision of the lubricant, e.g. for lubricating a rotor shaft of the pump carrying a pump rotor, is only possible under particular difficulties. A further advantage is that a shaft seal can be dispensed with on the non-drive side by the use of a self-lubricating or product-lubricated bearing since the shaft no longer has to be led out to the atmosphere. Pumps for conveying multiphase mixtures such as for conveying crude oil can be named as prominent examples in addition to a plurality of further applications. Such pumps frequently have to be operated at locations which are very difficult to access, frequently many hundreds of meters, even up to some thousand meters, beneath the ocean surface, where the pumps have to be operated reliably under extreme conditions over considerable time periods.

It is understood that the pumps should have as little maintenance effort as possible at such locations, or other locations, which are difficult to access and should in particular have low requirements in operating materials to be supplied externally such as special lubricating oil. With regard to the required lubrication of such pumps, the use of the medium to be pumped as a lubricant is the means of choice since the medium to be pumped is naturally anyway available in the pump, actually in practically any desired quantities, so that no lubricant has to be provided separately from outside and the lubricant also does not have to be replaced after a specific operating period because fresh and unconsumed lubricant is constantly available from the actual medium to be pumped.

The use of the medium to be pumped as a lubricant, however, naturally also has great advantages in other applications in which the pumps are easily accessible, for example, because actually no separate lubricant has to be provided, which makes the pumps more favorable in price and often simpler in the design of the apparatus in operation. A large part of the service work associated with the lubrication is dispensed with and the operating periods, that is the service intervals, are extended, not least because the regular replacement of the corresponding lubricant is no longer necessary.

A problem which has previously only been solved unsatisfactorily, however, occurs in the conveying of such pump media such as with a multiphase mixture which also contains natural gas and frequently also water and above all damaging solid portions such as sand in addition to crude oil. The additional ingredients are namely frequently rather harmful to the lubrication application. The skilled person thus immediately understands that, for example above all hard ingredients such as sand, can have a hugely negative effect on the lubrication. If, for example, a lubricant contaminated with sand is used for lubricating a rotor shaft of a pump wheel, the sand in the lubricant can cause considerable damage at the parts to be lubricated because the hard sand grains can damage the surfaces of the components to be lubricated which are frequently made of comparatively soft metal, which can ultimately result in the failure of the pump.

It is therefore known in the prior art to provide those parts which are lubricated, for example, using a lubricant contaminated with sand with special hardening so that the sand contained in the lubricant cannot damage the surfaces or to reduce the wear of the corresponding parts at least so much that reasonably long operating times, that is economically reasonable service intervals, can be achieved.

In this respect, the hardening of the corresponding parts, e.g. of the rotor shaft of an impeller of the pump or of the static or rotating counterparts and bearing components forming the rotor shaft bearing, is naturally a measure which is, on the one hand, very complex and thus expensive, and ultimately does not actually solve the problem because over time even the hardened parts cannot withstand the rubbing strain, e.g. by sand contained in the lubricant, over a long period. A further point is that, for example, also the width of the lubricant gaps between the rotating and/or static parts of the bearings can often not be reduced to the desired degree because otherwise the harmful influence of hard, non-compressible ingredients such as sand would become so great that a premature wear of the corresponding bearings would become unavoidable. Since the bearing gaps cannot be ideally set due to such restrictions, the running smoothness of the supported parts can be negatively influenced and damaging vibrations can occur in the operating state due to non-ideally set lubricant gaps, which can ultimately likewise result in premature wear.

In this respect, however, not only solid ingredients, but also liquid or gaseous ingredients can negatively influence the lubricating behavior because, for example, the viscosity, that is the sluggishness, of the pump fluid used as a lubricant is not well-suited, or is not at all suited, for the use as a lubricant.

It is therefore the object of the invention to propose a pump for conveying a pump fluid including an ingredient in which the medium to be pumped can simultaneously be used for lubricating rotating parts of the pump, in particular for lubricating the rotor shaft of the pump rotor, with the harmful influences of the ingredients on the lubricating process known from the prior art being very largely avoided. A further object of the invention is to provide a separation device as well as a rotor shaft for such a pump.

The subject matters of the invention satisfying this object are characterized by the features of the independent claims 1, 11 and 14.

The dependent claims relate to particularly advantageous embodiments of the invention.

The invention thus relates to a pump for conveying a pump fluid including an ingredient, with the pump fluid provided at an inlet pressure at a low-pressure side of the pump in the operating state being able to be conveyed to a high-pressure side of the pump by means of a pump rotor rotatably supported about an axis of rotation. In this respect, the pump rotor is designed and is arranged above a rotor shaft in a shaft bearing such that a lubricating film of a lubricating fluid formed from the pump fluid can be formed in a lubricating ring gap between the rotor shaft and the shaft bearing. In accordance with the invention, a separation device is provided at the rotor shaft by which a predefinable quantity of the ingredient can be separated from the pump fluid by means of a centrifugal force in the operating state for providing the lubricant.

It is thus essential to the invention that a separation device is provided at the rotor shaft by which a predefinable quantity of the ingredient, in practice frequently sand, can be separated from the pump fluid by means of a centrifugal force in the operating state. For this purpose, the pump fluid to be conveyed by the pump, for example crude oil charged with sand which is conveyed by the pump from a crude oil source to a reservoir, can be conveyed from the high-pressure side of the pump into a chamber of the separation device at the end of the rotor axle co-rotating with the rotor axle. The pump fluid in the rotating separation device is in this respect exposed to the centrifugal forces acting there due to the rotation and is conveyed outwardly, for example into an outer ring chamber of the separation device. Due to the higher density of the sand in comparison with the liquid portion of the pump fluid, the sand will collect at the outer margin of the ring chamber of the separation device under the centrifugal force so that a phase of the pump fluid highly charged with sand forms at the outer margin of the ring chamber and is preferably led off back to the low-pressure side of the pump via a corresponding outlet opening and is not used for the lubrication of e.g. the rotor shaft. The removal of the pump fluid which should be used for the lubrication in this respect takes place at a further inwardly disposed diameter of the ring chamber where a phase of the pump fluid with a low sand concentration has collected.

It is self-explanatory that in this manner fluid ingredients, such as liquid or viscous ingredients of high density which the pump fluid contains, can naturally also be separated in an analog manner to e.g. sand using the separation device in accordance with the invention so that, for example, the portion of the pump fluid which should be used for lubrication has a predefined suitable viscosity which is not too high, for example, because more viscous portions can be removed by the separation device.

A suitable geometry of the cross-sections flowed through is fixed, for example by a loss calculation, so that a throughflow or a ratio of the throughflows of the pump fluid highly charged with the ingredient, on the one hand, and of the pump fluid largely purified of the ingredient flowing through the ring gap between the rotor shaft and the rotor bearing, on the other hand is reliably ensured through the outlet opening.

It is thus possible for the first time by the present invention not only to separate solid ingredients, but also liquid or gaseous ingredients which have a negative influence on the lubricating behavior from the pump fluid to be conveyed such that a phase of the pump fluid purified from ingredients to a sufficient degree is provided which can be used for lubricating rotating parts of the pump, with the harmful influences of the ingredients on the lubricating process known from the prior art being very largely avoided. In this respect, depending on the exact composition and consistency of the pump fluid or of the ingredients, mixing phenomena or solution phenomena can, for example, also become relevant which can further positively influence the process of separation. It is thus possible, for example, that gas portions are dissolved in high viscosities or in fluid components of higher density or are included, for example, in the form of bubbles, and are thus likewise co-separated by the separation device in accordance with the invention. Other processes known per se can naturally also contribute to the fact that not only components of higher density can be separated via the separation device, but also those with lower density because they are taken along by the components of higher density.

As already mentioned, in an embodiment particularly preferred for practice for supplying the pump fluid including the ingredient, in particular sand, the separation device is connected to the high-pressure of the pump via a feed line. In this respect, the feed line can, for example, be an integral component of the pump housing, in particular a bore or bore-like connection opening extending in the pump housing or pump stator or the feed line, can also be realized by a separate line which connects the high-pressure side to the separation chamber.

Specifically, the separation device co-rotating about the axis of rotation includes an outer ring chamber at which ring chamber a substantially tangentially oriented separation opening is provided for separating the ingredient, with the separation opening particularly preferably being connected to the low-pressure side of the pump via a separation line for leading off a solid. In this respect, the separation line can naturally also specifically be an integral component of the pump housing, in particular a bore or bore-like connection opening extending in the pump housing or pump stator, or the separation line can also be realized by a separate line which connects the separation opening of the separation chamber to the low-pressure side of the pump, or which connects to another point having a lower pressure, with the ingredient, that is frequently sand in practice, but also another liquid or gaseous fluid component of the pump fluid, in this respect, preferably, but as explained above not necessarily, having a higher density than the phase of the pump fluid used as a lubricating fluid.

So that, for example, the shaft bearing in which the rotor shaft of the pump is supported, can be ideally supplied with the phase of the pump fluid purified from the ingredient for the lubrication, the lubrication ring gap is in particular flow-connected to the separation device by means of a lubricant opening so that the lubricating fluid at least partly liberated of the ingredient can be fed to the lubricating ring gap via the lubricant opening for lubricating the shaft bearing.

In a specific embodiment, an additional lubricant line can be provided such that a predefinable quantity of lubricating fluid is removed from the separation device and can be used for feeding a further lubricating point of the pump. In this respect, the lubricant line can naturally also specifically be an integral component of the pump housing, in particular a bore or bore-like connection opening extending in the pump housing or pump stator, or the lubricant line can also be realized by a separate line which connects the separation device of the separation chamber to the further lubricating point in the pump.

Depending on the application and the embodiment, the separation device can either be releasably connected to the rotor shaft, with the separation device in particular being able to be designed as a separation disk which can be screwed to the rotor shaft. In this respect, it is naturally also possible that the separation device is an integral component of the rotor shaft, with the separation device in particular being able to be a separation disk integrally connected to the rotor shaft.

The invention further relates to a separation device for a pump in accordance with the invention, with the separation device particularly preferably being designed as a separation disk which can be screwed to a rotor shaft of the pump.

In practice, the separation device in this respect specifically includes an outer ring chamber at which ring chamber a preferably substantially tangentially oriented separation opening is provided for separating an ingredient, in particular sand.

The invention finally also relates to a rotor shaft for a pump having a separation device of the present invention, with the separation device particularly preferably being releasably connected to the rotor shaft.

Figure 1B:
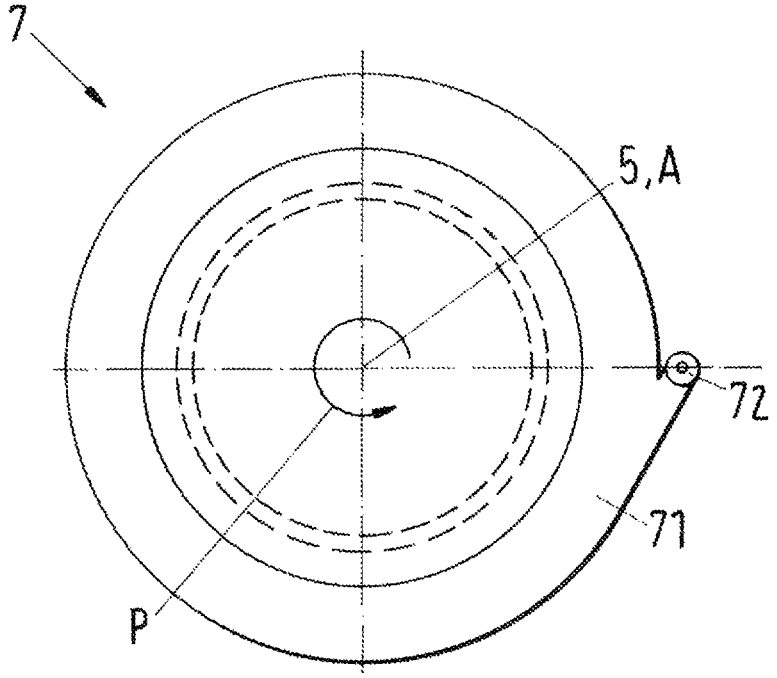
Figure 1C:
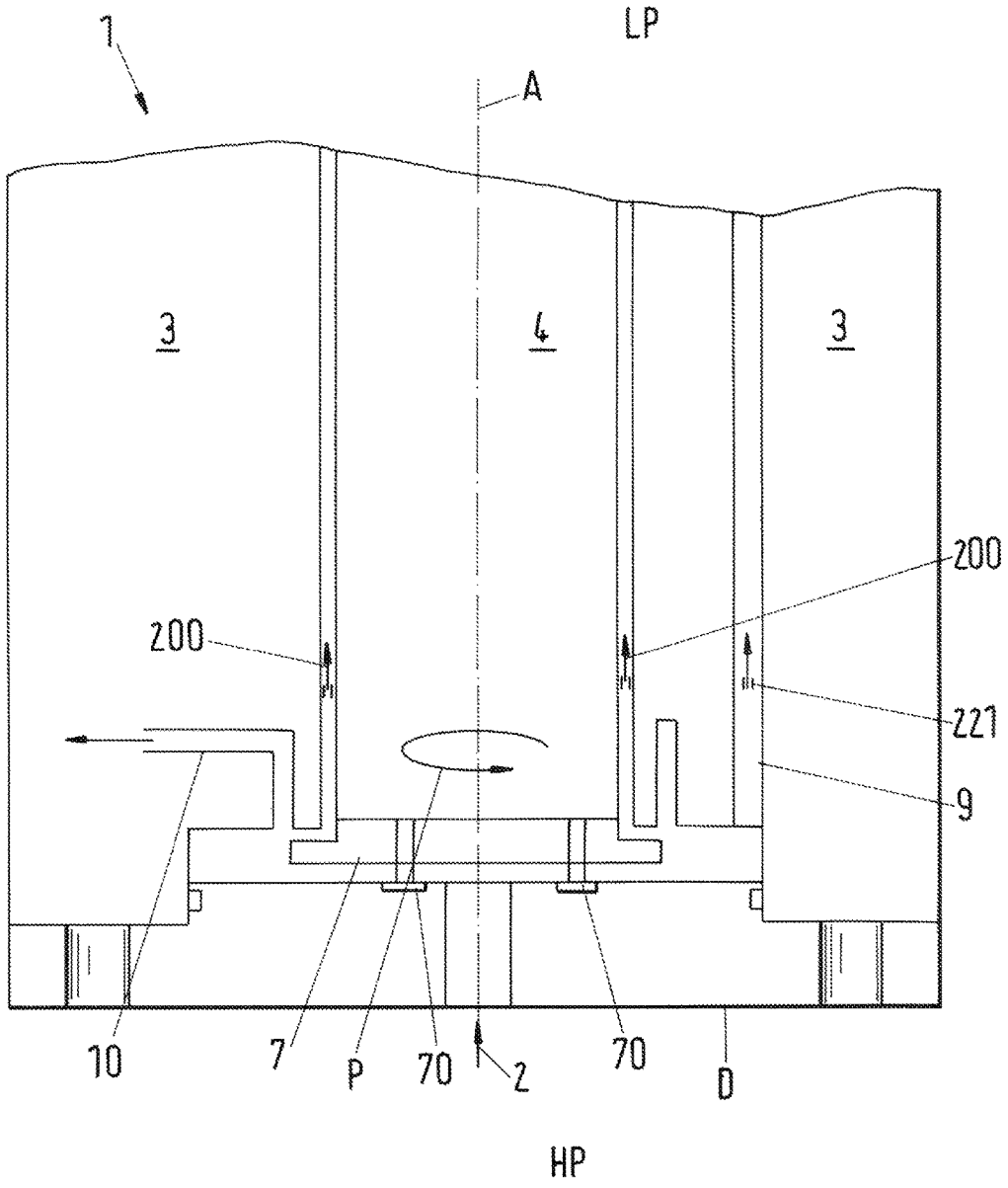
Figure 2:
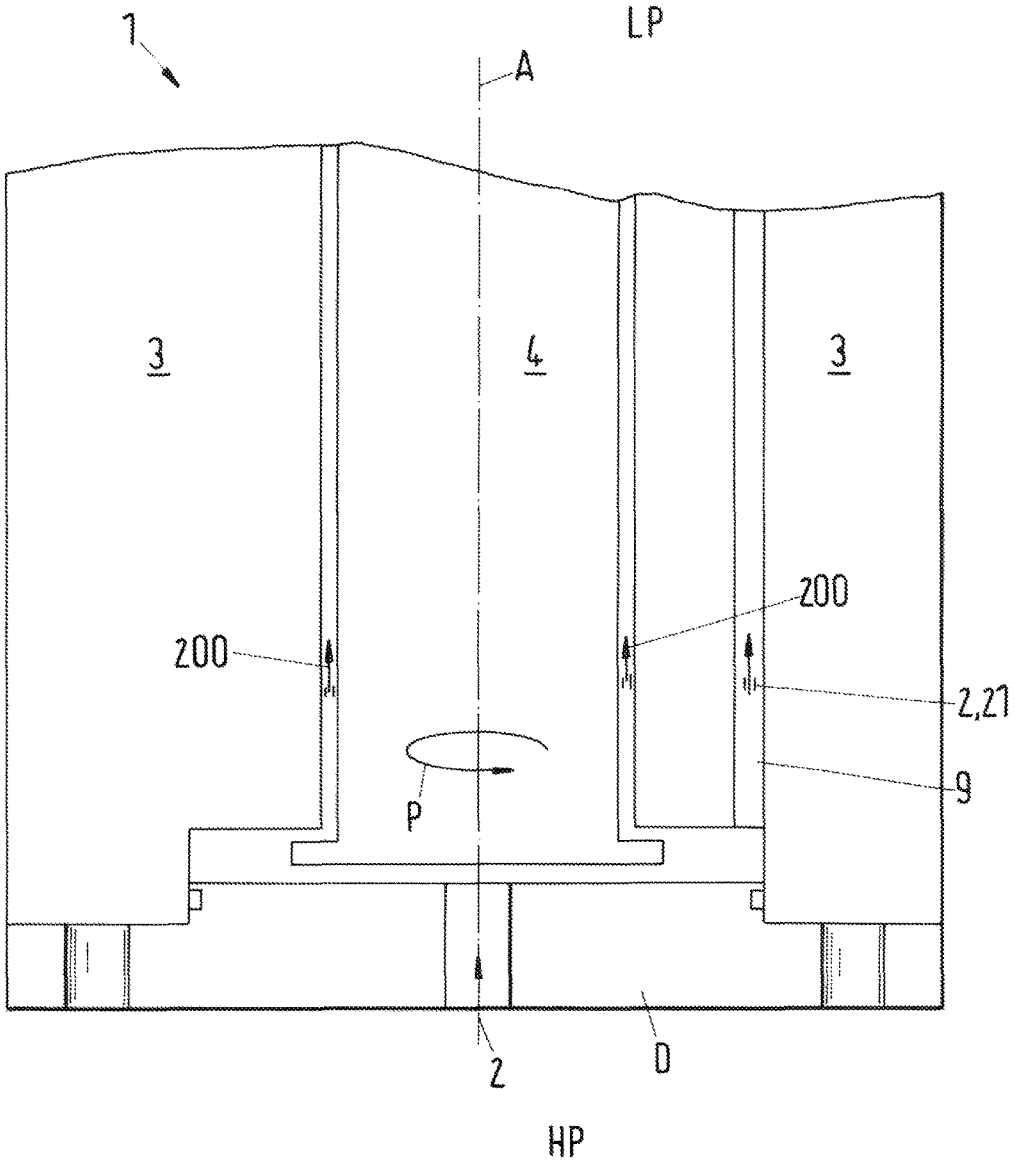

The invention will be explained in more detail in the following with reference to the drawing. There are shown in a schematic representation:

FIG. 1*a* an embodiment of a pump in accordance with the invention with a separation disk;

FIG. 1*b* the separation disk of the pump in accordance with FIG. 1*a* in detail;

FIG. 1*c* the shaft bearing of the pump in accordance with FIG. 1*a* in detail; and FIG. 2 another variant of a shaft bearing of a pump in accordance with the invention.

A particularly preferred embodiment of a pump in accordance with the invention having a separation device in the form of a separation disk will be discussed in the following with reference to FIG. 1*a*, with FIG. 1*b* showing the separation disk and FIG. 1*c* showing the design of the shaft bearing of the pump in accordance with FIG. 1*a* somewhat more exactly in detail.

The pump in accordance with the invention, which is designated as a whole by the reference numeral 1 in the following, serves very generally and in particular in the specific embodiment of FIG. 1*a* for conveying a pump fluid 2 including an ingredient 21. The ingredient 21 in the example of FIGS. 1*a* to 1*c* is substantially sand which is present in non-tolerable quantities as a contaminant in the pump fluid 2. The pump fluid 2 is crude oil here which is available at a low-pressure side LP of the pump 1 at an inlet pressure P1 and which is conveyed to a high-pressure side HP of the pump 1 by means of a pump rotor 4 rotatably supported in a pump stator 3 about an axis of rotation A in accordance with the arrow P in the operating state. The pump rotor 4 is in this respect designed and is arranged above a rotor shaft 5 in a shaft bearing 6 such that a lubricating film 20 from a lubricating fluid 200 formed from a pump fluid 2 can be formed in a lubricating ring gap 21 between the rotor shaft 5 and the shaft bearing 6. In accordance with the invention, a separation device 7 is provided at the rotor shaft 5 by which a predefinable quantity of the ingredient 21 can be separated from the pump fluid 2 by means of a centrifugal force in the operating state for providing the lubricating fluid 200.

As shown schematically in FIG. 1*a*, the separation device 7, which is here designed as a separation disk screwed to the rotor shaft 5 of the pump 1 by screws 70, is connected to the high-pressure side HP of the pump 1 via a feed line 8 for feeding the pump fluid 2 including the ingredient 21, that is here the crude oil. The separation disk is in this respect covered by a cover D through which the pump fluid 2 is supplied to the separation disk.

In accordance with FIG. 1*a* or FIG. 1*b*, which shows the separation disk of FIG. 1*a* again somewhat more exactly in detail, the separation disk co-rotating with the rotor shaft 5 about the axis of rotation A includes an outer ring chamber 71, with a substantially tangentially oriented separation opening 72 being provided for separating the ingredient 21. The separation opening 72 is connected via a separation line 9 to the low-pressure side LP of the pump 1 for leading off the solid 21, that is in the present example for leading off the sand deposited in the crude oil. In this respect, the sand has a higher density than the lubricating fluid 200 which, as will be explained further below, is finally used for lubricating the rotor shaft 5.

So that the lubricating fluid 200 can be provided for lubricating the rotor shaft 5 in the shaft bearing 6, the lubricating ring gap 21 is flow-connected to the separation device 7 by means of a lubricant opening 22 such that the lubricating fluid 200 at least partly liberated from sand can be fed via the lubricant opening 22 to the lubricant ring gap 21 for lubricating the shaft bearing 6.

A lubricant line 10 is furthermore additionally provided such that a predefinable quantity of lubricant fluid 200 can be led off by the separation disk, in particular for feeding a further lubricant point of the pump 1 which additional lubricant points are not explicitly shown for reasons of clarity. In this respect, it is even possible that the lubricating fluid 200 branched off via the lubricant line 10 is used for lubricating further plant parts which are disposed outside the pump 1 or which are not part of the pump 1.

As shown somewhat more clearly schematically in FIG. 1*c*, the separation device 7, that is here the separation disk in accordance with FIG. 1*a*, is, as already briefly mentioned, releasably connected to the rotor shaft 5.

In this respect, it is, however, naturally also possible in another embodiment that the separation device 7 is an integral component of the rotor shaft 5 and, as shown schematically, for example, with reference to FIG. 2, the separation device 7 is in particular a separation disk integrally connected to the rotor shaft 5. The embodiment in accordance with FIG. 2 thus only differs from the embodiment shown in FIG. 1*c* in that the separation disk is integrally connected to the rotor shaft 5 and, beyond this, no additional lubricant line 10 is provided because in the example of FIG. 2 the lubricant 200 is only required for lubricating the rotor shaft 5 and is not required at any further point.

In all the embodiments shown here only by way of example in the Figures, the separation line 9 is formed as an integral component in the pump stator 3, but can also be guided as a separate additional separation line, for example outwardly at the housing of the pump.

It is understood that all the above-described embodiments of the invention are only to be understood as examples or by way of example and that the invention in particular, but not only, includes all suitable combinations of the described embodiments.

The invention claimed is:

1. A pump for conveying a pump fluid including an ingredient, wherein the pump fluid provided at a low-pressure side of the pump at an inlet pressure in an operating state can be conveyed to a high-pressure side of the pump by means of a pump rotor rotatably supported about an axis of rotation in a pump stator and the pump rotor is designed and is arranged above a rotor shaft in a shaft bearing such that a lubricating film of a lubricating fluid formed from the pump fluid is formed in a lubricating ring gap between the rotor shaft and the shaft bearing, wherein a separation device is provided on and rotatable by the rotor shaft and is configured to separate a predefinable quantity of the ingredient from the pump fluid by means of a centrifugal force generated by the rotation of the separation device for providing the lubricating fluid-in the operating state, and wherein the separation device is connected to a separation line configured to transport the separated ingredient from the separation device to the low-pressure side of the pump.

2. A pump in accordance with claim 1, wherein the separation device is connected to the high-pressure side of the pump via a feed line for feeding the pump fluid including the ingredient.

3. A pump in accordance with claim 1, wherein the separation device co-rotates with the rotor shaft about the axis of rotation and includes an outer ring chamber with a substantially tangentially oriented separation opening provided for separating the ingredient.

4. A pump in accordance with claim 1, wherein the ingredient has a higher density than the lubricating fluid and/or the ingredient is a solid.

5. A pump in accordance with claim 1, wherein the lubricating ring gap is flow-connected to the separation device by means of a lubricant opening such that lubricating fluid at least partly liberated from the ingredient can be fed to the lubricating ring gap via the lubricant opening for lubricating the shaft bearing.

6. A pump in accordance with claim 1, wherein a lubricant line is provided such that a predefinable quantity of lubricating fluid can be led off from the separation device for feeding a further lubricating point of the pump.

7. A pump in accordance with claim 1, wherein the separation device is releasably connected to the rotor shaft; and/or the separation device is a separation disk screwable to the rotor shaft.

8. A pump in accordance with claim 1, wherein the separation device is an integral component of the rotor shaft; and/or the separation device is a separation disk integrally connected to the rotor shaft.

9. A pump in accordance with claim 1, wherein the separation line is formed as an integral component in the pump stator.

10. A separation device for a pump in accordance with claim 1.

11. A separation device in accordance with claim 10, wherein the separation device is a separation disk screwable to the rotor shaft of the pump.

12. A separation device in accordance with claim 10, wherein the separation device includes an outer ring chamber at which ring chamber a substantially tangentially oriented separation opening is provided for separating the ingredient.

13. A rotor shaft for a pump in accordance with claim 1, having a separation device.

14. A rotor shaft in accordance with claim 13, wherein the separation device is releasably connectable to the rotor shaft.

15. A separation device in accordance with claim 1, wherein the pump fluid is crude oil and the ingredient is sand.

* * * * *